US009657703B2

(12) United States Patent
Fujita

(10) Patent No.: US 9,657,703 B2
(45) Date of Patent: May 23, 2017

(54) INTERNAL COMBUSTION ENGINE STARTING DEVICE

(71) Applicant: DENSO CORPORATION, Kariya, Aichi-pref. (JP)

(72) Inventor: Tatsuya Fujita, Kariya (JP)

(73) Assignee: DENSO CORPORATION, Kariya (JP)

( * ) Notice: Subject to any disclaimer, the term of this patent is extended or adjusted under 35 U.S.C. 154(b) by 70 days.

(21) Appl. No.: 14/930,103

(22) Filed: Nov. 2, 2015

(65) Prior Publication Data

US 2016/0245254 A1 Aug. 25, 2016

(30) Foreign Application Priority Data

Feb. 20, 2015 (JP) ..... 2015-31244

(51) Int. Cl.
*F02N 1/00* (2006.01)
*F02N 11/08* (2006.01)

(52) U.S. Cl.
CPC ..... *F02N 11/0851* (2013.01); *F02N 11/0822* (2013.01); *F02N 11/0866* (2013.01); *F02N 2200/0801* (2013.01); *F02N 2200/101* (2013.01)

(58) Field of Classification Search
CPC .. F02N 11/00; F02N 11/0818; F02N 11/0844; F02N 2300/00
USPC .. 123/179.1, 179.3, 179.4, 179.14, 491, 689
See application file for complete search history.

(56) References Cited

U.S. PATENT DOCUMENTS

2002/0070555 A1 6/2002 Osada et al.
2003/0022755 A1* 1/2003 Mizutani ..... F02D 41/0225 477/107
2003/0085677 A1* 5/2003 Wakitani ..... B60L 7/003 318/139
2004/0002808 A1* 1/2004 Hashimoto ..... F02D 11/107 701/107
2004/0231349 A1* 11/2004 Ikura ..... B60H 1/322 62/236
2013/0166173 A1* 6/2013 Ideshio ..... B60W 20/00 701/103
2014/0371965 A1* 12/2014 Ideshio ..... B60K 6/383 701/22

FOREIGN PATENT DOCUMENTS

JP 2002-161838 A 6/2002

* cited by examiner

*Primary Examiner* — John Kwon
(74) *Attorney, Agent, or Firm* — Oliff PLC

(57) ABSTRACT

An internal combustion engine starting device includes: a starting requirement determination device that determines whether an internal combustion engine is required to be started when the engine stops combustion by stopping fuel supply to the engine, and the vehicle is in a freewheel running; and a driving control device that drives and rotates a motor in a starter by increasing a driving voltage to the motor from a voltage changing device for changing the driving voltage supplied to the starter in a case where a travelling speed is high to be higher than in a case where the traveling speed is low, when the internal combustion engine is required to be started.

8 Claims, 7 Drawing Sheets

INTERNAL COMBUSTION ENGINE STARTING DEVICE

CROSS REFERENCE TO RELATED APPLICATION

This application is based on Japanese Patent Application No. 2015-31244 filed on Feb. 20, 2015, the disclosure of which is incorporated herein by reference.

TECHNICAL FIELD

The present disclosure relates to an internal combustion engine starting device for a vehicle, which includes an internal combustion engine as a traveling power source, and a starter for applying an initial rotation to a ring gear linked to an output shaft of the internal combustion engine.

BACKGROUND

As such a device, a device which makes a driving voltage of a starter motor variable in accordance with a state of a vehicle is known. For example, in JP-2002-161838 A (corresponding to US 2002/0070555), in a case where the internal combustion engine is required to be restarted during the period of time when the internal combustion engine is automatically stopped by idling stop control, the driving voltage of a starter becomes higher than that in a case where the internal combustion engine is required to be started by a key operation of a driver.

However, as a technology for improving fuel efficiency, coasting control is known. The coasting control is a technology which stops combustion of an internal combustion engine by performing a fuel cut of the internal combustion engine, and allows a vehicle to perform inertial traveling by making a clutch device provided between the internal combustion engine and a transmission be in a power blocking state. In the middle of the coasting control, a traveling speed of the vehicle is relatively high. For this reason, when the internal combustion engine is required to be started in the middle of the coasting control, the rotation speed of the engine is required to be rapidly raised to a high rotation speed in accordance with the traveling speed of the vehicle after improving acceleration of the vehicle from the state of the coasting control without causing the driver to experience discomfort.

SUMMARY

It is an object of the present disclosure to provide an internal combustion engine starting device, which improves acceleration of a vehicle when returning from coasting control.

According to an example aspect of the present disclosure, an internal combustion engine starting device for a vehicle that includes: an internal combustion engine as a traveling power source; a clutch device arranged on a power transmission path for linking an output shaft of the internal combustion engine and a driving wheel; a starter having a motor for applying an initial rotation to a ring gear linked to the output shaft; and a voltage changing device for changing a driving voltage supplied to the starter, includes: a starting requirement determination device that determines whether the internal combustion engine is required to be started in a state where the internal combustion engine stops combustion by stopping fuel supply to the internal combustion engine, and the vehicle is in a freewheel running with setting a clutch device to be in a power blocking state; and a driving control device that drives and rotates the motor by increasing a driving voltage supplied to the motor from the voltage changing device in a case where a travelling speed is high to be higher than in a case where the traveling speed is low, when the starting requirement determination device that determines that the internal combustion engine is required to be started.

In the above internal combustion engine starting device, in a case where it is determined that the internal combustion engine is required to be started in the middle of the coasting of the vehicle, when the traveling speed of the vehicle is high, the motor is driven to be rotated by making a driving voltage supplied to the motor of the starter from the voltage changing device higher than that of when the traveling speed is low. When the driving voltage of the motor is set to be high, the raising speed of rotation of the ring gear linked to the output shaft of the internal combustion engine can be set to be high as the raising speed of the rotation of the motor can be set to be high. For this reason, even when the internal combustion engine is required to be started in the middle of the coasting with a relatively high traveling speed of the vehicle, the internal combustion engine can be started by rapidly raising the rotation speed of the engine to a high rotation speed. Accordingly, the acceleration of the vehicle can be improved when returning from the state of the coasting.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

First Embodiment

Hereinafter, a first embodiment which specifies the present disclosure will be described with reference to the drawings. This embodiment selectively realizes normal traveling in which traveling is performed by setting a clutch device to be in a power transmission state, and inertial traveling (coasting traveling) in which traveling is performed by setting the clutch device to be in a power blocking state, in a vehicle provided with an engine which functions as a traveling power source.

Figure 1:
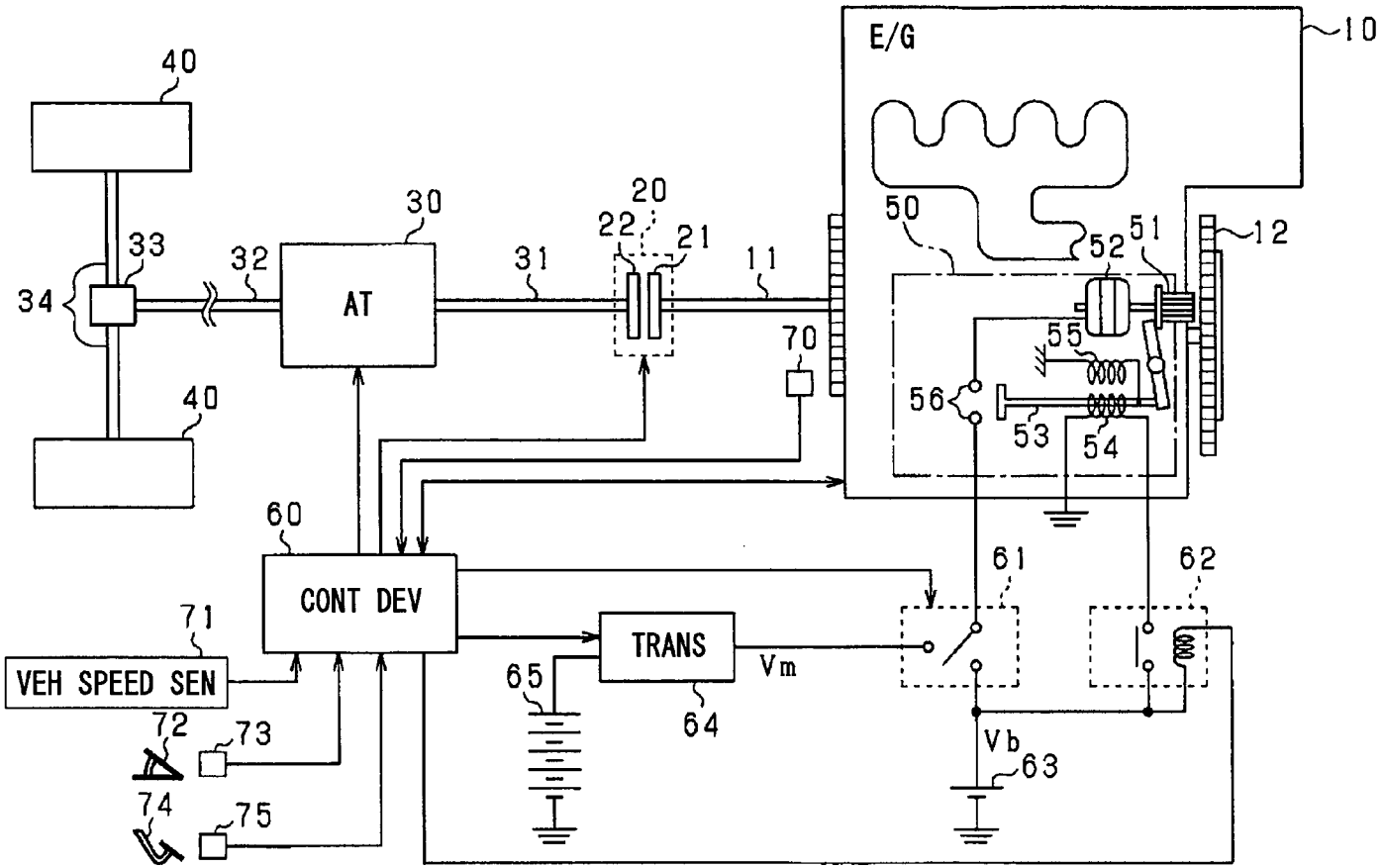
FIG. 1 is a configuration view of the entire onboard system according to a first embodiment.

As illustrated in FIG. 1, the vehicle includes an engine 10, a clutch device 20, an automatic transmission 30, a driving wheel 40, a starter 50, and a control device 60 (ECU). The engine 10 is a multiple cylinder internal combustion engine which is driven by combustion of fuel, such as gasoline or diesel fuel, and includes a known fuel injection valve or the like.

The automatic transmission 30 is mechanically connected to an output shaft (crank shaft 11) of the engine 10 via the clutch device 20. The clutch device 20 is provided with a group of clutch mechanisms which includes a first rotating body 21 (for example, a fly wheel) connected to the crank shaft 11, and a second rotating body 22 (for example, a clutch disk) connected to an input shaft 31 of the automatic transmission 30. As both the rotating bodies 21 and 22 are in contact with each other in the clutch device 20, a power transmission state in which the power is transmitted between the engine 10 and the automatic transmission 30 is achieved, and as both the rotating bodies 21 and 22 are separated from each other, a power blocking state in which the power transmission is blocked between the engine 10 and the automatic transmission 30 is achieved. The clutch device 20 of this embodiment is configured to be capable of performing switching of the power transmission state and the power blocking state by a conduction operation. The clutch device 20 may be provided inside the automatic transmission 30.

The automatic transmission 30 outputs the power of the engine 10 input from the input shaft 31 to an output shaft 32 of the automatic transmission 30 by changing the speed by using a traveling speed or an engine rotation speed of the vehicle, and a gear ratio which corresponds to a shift position of the automatic transmission 30. The automatic transmission 30 is provided with an automatic shift mechanism which is made of an actuator of a motor and a hydraulic system.

The driving wheel 40 is mechanically connected to the output shaft 32 of the automatic transmission 30 via a differential gear 33 and a drive shaft 34.

The starter 50 is a pinion extrusion type, and includes a pinion gear 51, a motor 52 which drives and rotates the pinion gear 51, a plunger 53, a coil 54 which suctions and moves the plunger 53 in a direction of a shaft line according to conduction, and a return spring 55. In this embodiment, the plunger 53, the coil 54, and the return spring 55 correspond to "pinion shift device".

A first battery 63 is connected to the coil 54 via a relay 62. A second battery 65 is connected to the motor 52 via a contact point 56 and a switching portion 61. A transformation portion 64 is connected to the motor 52 via the contact point 56 and the switching portion 61. The switching portion 61 is switching device for selecting any one of an output voltage of the first battery 63 and an output voltage of the transformation portion 64, and for supplying the selected output voltage to the motor 52 via the contact point 56. The transformation portion 64 transforms and outputs the output voltage of the second battery 65. As the transformation portion 64, for example, a raising and lowering voltage chopper circuit which can raise and lower the output voltage of the second battery 65 can be used. In other words, in this embodiment, the switching portion 61, the first battery 63, the transformation portion 64, and the second battery 65 correspond to "voltage changing device".

When an ON driving command of the starter 50 is not output to the relay 62 from the control device 60, the relay 62 is in a blocked state. At this time, conduction to the coil 54 is not performed, and the pinion gear 51 is positioned at a non-linking position where the pinion gear 51 is in a state of not being in contact with a ring gear 12 linked to the crank shaft 11, due to a biasing force of the return spring 55. Meanwhile, when the ON driving command is output, the relay 62 is in a conducted state. At this time, conduction to the coil 54 is performed, the pinion gear 51 overcomes the biasing force of the return spring 55, the plunger 53 is suctioned in the direction of the shaft line, and the pinion gear 51 is extruded toward a linking position where the pinion gear 51 meshes with the ring gear 12. As teeth provided on an outer circumferential edge of the pinion gear 51 mesh between the teeth provided at an outer circumferential edge of the ring gear 12, the teeth of the pinion gear 51 and the teeth of the ring gear 12 mesh with each other. As the contact point 56 is in a conducted state by the plunger 53, conduction to the motor 52 is performed. Accordingly, the ring gear 12 is rotated by the pinion gear 51, and an initial rotation is imparted to the engine 10 (cranking is performed).

After this, when the output of the ON driving command is stopped, the relay 62 is in a blocked state, and the conduction to the coil 54 is stopped. For this reason, the plunger 53 is moved by the biasing force of the return spring 55. Accordingly, the driving of the motor 52 starts to be stopped, and the pinion gear 51 is disengaged from the ring gear 12.

The rotating force of the motor 52 is practically transmitted to the pinion gear 51 via a one-way clutch which is not illustrated. The one-way clutch is a member which only transmits the rotating force that makes the pinion gear 51 and the ring gear 12 rotate together from the motor 52 to the pinion gear 51, and blocks the pinion gear 51 from rotating together due to the rotation of the crank shaft 11 by idling.

In the vehicle, a crank angle sensor 70 which detects a rotation angle of the crank shaft 11, and a vehicle speed sensor 71 which detects the traveling speed of the vehicle, are provided. In the vehicle, an accelerator sensor 73 which detects an operation amount (stepping-in amount) of an accelerator operating member 72 (accelerator pedal) of the driver, and a brake sensor 75 which detects an operation amount (stepping-in amount) of a brake operating member 74 (brake pedal) of the driver, are provided.

Output signals of each of the above-described sensors are input to the control device 60. The control device 60 is configured of a microcomputer which is made of a CPU, a ROM, or a RAM, as a whole, and executes various types of control programs stored in the ROM. Accordingly, combustion control of the engine 10, or transmission control of the automatic transmission 30 are performed. Here, the transmission control is for operating the automatic transmission 30 so that the gear ratio decreases as the traveling speed (hereinafter, a vehicle speed Sp) of the vehicle detected by the vehicle speed sensor 71 increases. For example, when the automatic transmission 30 is a stepped transmission, the automatic transmission 30 is operated so that the gear ratio gradually decreases as the vehicle speed Sp increases. In this embodiment, the gear ratio is a value "Nin/Nout" which is obtained by dividing a rotation speed Nin of the input shaft 31 of the automatic transmission 30 by a rotation speed Nout of the output shaft 32.

In this embodiment, each of the above-described controls is configured to be performed by one control device 60. However, the configuration is not limited thereto, and for example, each of the combustion control and the transmission control may be configured to be performed by separate control devices.

The control device 60 further performs coasting control. The coasting control stops combustion of the engine 10 by performing fuel cut of the engine 10, and allows the vehicle to perform inertial traveling by setting the clutch device 20 to be in a power blocking state. Accordingly, an effect of improved fuel efficiency is realized. In particular, in this embodiment, when returning from the coasting control, the driving control of the starter 50 which is capable of improving acceleration of the vehicle is performed.

Figure 2:
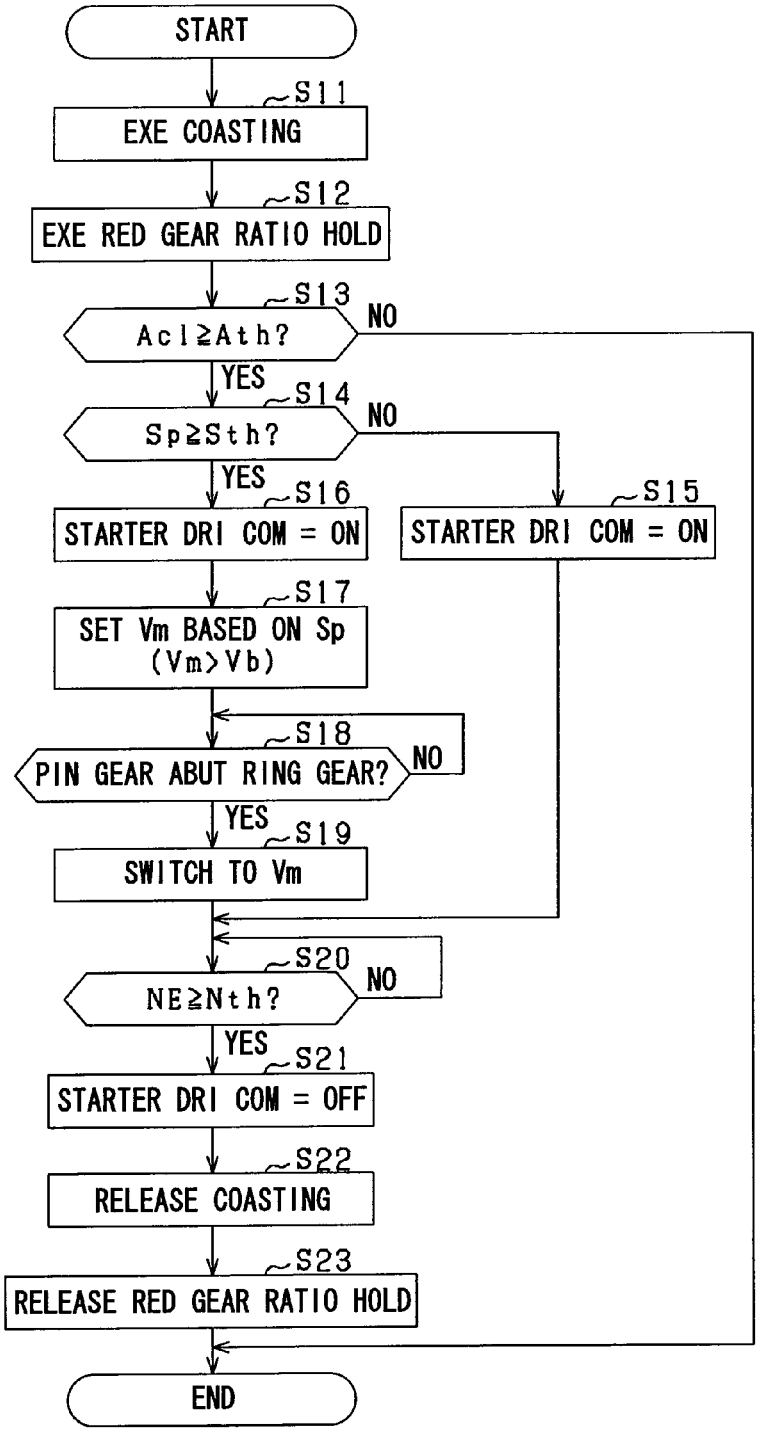
FIG. 2 is a flow chart illustrating an order of processing regarding coasting control.

In FIG. 2, an order of a returning process from the coasting control according to this embodiment is illustrated. The processing is repeatedly performed by a predetermined cycle by the control device 60, for example. The processing illustrated in FIG. 2 is performed when performance conditions of the coasting control are established, and the coasting control is performed. In this embodiment, a condition that an engine rotation speed NE is equal to or greater than a predetermined rotation speed (for example, equal to or greater than an idling rotation speed), and a condition that the vehicle speed Sp is within a predetermined range of vehicle speed (for example, 40 km/h to 120 km/h), are included in the above-described performance conditions. The engine rotation speed NE may be calculated based on the output signal of the crank angle sensor 70, for example.

In the series of processing, in a step S11, the coasting control which sets the clutch device 20 to be in a power blocking state, and stops the combustion of the engine 10, is performed.

In the following step S12, reduction gear ratio holding processing for holding a gear ratio which is a gear ratio of the automatic transmission 30 immediately before transitioning to the current coasting control, and which a gear ratio in a normal traveling state, is performed. In this embodiment, processing of the step corresponds to "holding operation device".

In the following step S13, it is determined whether or not an accelerator operation amount Ac1 calculated based on the output signal of the accelerator sensor 73 is equal to or greater than a predetermined amount Ath (>0). The processing is processing for determining whether or not a releasing condition of the coasting control is established, that is, whether or not starting of the engine 10 is required. In other words, in this embodiment, the processing of the step corresponds to "starting requirement determination device".

When it is determined to be positive in the step S13, it is determined that the releasing condition of the coasting control is established, and the processing moves to a step S14. In the step S14, it is determined whether or not the vehicle speed Sp is equal to or greater than a regulation speed Sth (>0). The processing is processing for determining whether or not cranking is required to be performed by driving the motor 52 at a high speed. The above-described regulation speed Sth is set to be a value within the predetermined range of vehicle speed under the performance condition of the above-described coasting control. Specifically, for example, the regulation speed Sth is set to be a value on a lower limit value side than the center within the above-described predetermined range of vehicle speed.

When it is determined to be negative in the step S14, the processing moves to a step S15, and the normal starting processing is performed. The processing is processing for operating the switching portion 61 to be conducted so that the first battery 63 and the contact point 56 are connected to each other, and for setting the relay 62 to be in a conducted state by outputting the ON driving command of the starter 50. Accordingly, an output voltage Vb (for example, 12V) of the first battery 63 is supplied to the starter 50. The initial rotation is imparted to the ring gear 12 by the pinion gear 51 in a state where the pinion gear 51 meshes with the ring gear 12. In addition, the combustion control is also performed for initiating the combustion of the engine 10, together with the processing of the step.

Meanwhile, when it is determined to be positive in the step S14, cranking is performed by driving the motor 52 at a high speed in the steps S16 to S19. Specifically, first, the switching portion 61 is operated to be conducted so that the first battery 63 and the contact point 56 are connected to each other, and the relay 62 is set to be in a conducted state by outputting the ON driving command of the starter 50, in the step S16. Accordingly, the pinion gear 51 is started to move toward the linking position.

Figure 3:
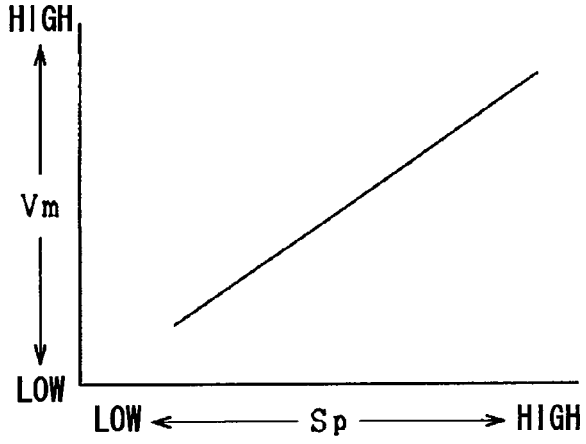
FIG. 3 is a view illustrating a relationship between a traveling speed and a starter driving voltage.

In the following step S17, based on the vehicle speed Sp, an output voltage Vm of the transformation portion 64 is set to be higher than the output voltage Vb of the first battery 63. In this embodiment, as illustrated in FIG. 3, the output voltage Vm of the transformation portion 64 is set to sequentially increase as the vehicle speed Sp increases.

In other words, the engine rotation speed which is required for starting the engine 10 increases as the traveling speed increases. Specifically, the required engine rotation speed increases in proportion to the traveling speed. Meanwhile, the raising speed of rotation of the motor 52 increases as the voltage supplied to the motor 52 increases. For this reason, the output voltage Vm of the transformation portion 64 is set to sequentially increase as the vehicle speed Sp increases, and accordingly, the engine rotation speed is rapidly raised up to a required value of the engine rotation speed which corresponds to the traveling speed.

Returning to the description of FIG. 2 above, it is determined whether or not the pinion gear 51 abuts against the ring gear 12 in the following step S18. Whether or not the pinion gear 51 abuts against the ring gear 12 may be determined by determining whether or not elapsed time from the output of the ON driving command is equal to or greater than the threshold time in step S16.

When it is determined to be positive in the step S18, the processing moves to a step S19, and the switching portion 61 is operated so that the transformation portion 64 and the contact point 56 are connected to each other. In addition, the combustion control for starting the combustion of the engine 10 is also started. By the operation of the switching portion 61, the voltage supplied to the motor 52 is raised from the output voltage Vb of the first battery 63 to the output voltage Vm of the transformation portion 64. The reasons why the voltage supplied to the coil 54 is not used as the output voltage of the transformation portion 64, but as the output voltage of the first battery 63 during the period of time from when the ON driving command of the starter 50 is output in the step S16 to the point in time when it is determined to be positive in the step S18, will be described.

Figure 4:
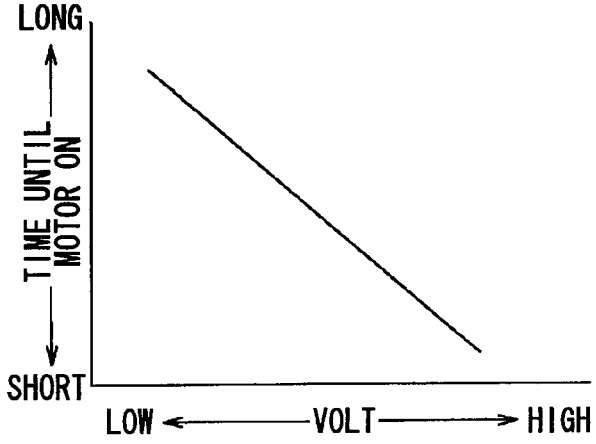
FIG. 4 is a view illustrating a relationship between the starter driving voltage and a point in time when a motor starts to rotate.

The starter 50 is configured so that the driving voltage is started to be supplied to the motor 52 after the voltage is supplied to the coil 54 and the pinion gear 51 starts to move toward the linking position from the non-linking position. As illustrated in FIG. 4, the starter 50 is configured so that the period of time from the output of the ON driving command until the motor 52 starts to rotate becomes shorter as the voltage supplied to the coil 54 increases. For this reason, the pinion gear 51 moves to the linking position and starts to rotate before the pinion gear 51 meshes with the ring gear 12 when the voltage supplied to the coil 54 increases, and then, the pinion gear 51 abuts against the ring gear 12 in a state where the pinion gear 51 rotates. As a result, abrasion of the pinion gear 51 or the ring gear 12 advances, a defective meshing between the pinion gear 51 and the ring gear 12 is generated, or a collision sound between the pinion gear 51 and the ring gear 12 becomes louder.

The voltage supplied to the coil 54 during the period when the pinion gear 51 moves from the non-linking position to the linking position is set to be lower than the voltage supplied to the motor 52 after the pinion gear 51 moves to the linking position. Accordingly, the period from the time when the voltage starts to be supplied to the coil 54 to the point in time when the motor 52 starts to rotate can become longer, and the period until the pinion gear 51 meshes with the ring gear 12 can be ensured. Therefore, generation of the defective meshing or an increase in the collision sound can be restricted. In other words, in this embodiment, the processing of the steps S17 to S19 corresponds to "driving control device".

It is determined whether or not the engine rotation speed NE is equal to or greater than a determined speed Nth (>0) in the following step S20. The processing is processing for determining whether or not the driving of the starter 50 may be stopped. The determined speed Nth is set to be a value which can determine whether or not the engine rotation speed NE is raised to the rotation speed which is appropriate for the vehicle speed Sp after the first combustion is generated in the engine 10 while cranking. Specifically, for example, the determined speed Nth is set to increase as the vehicle speed Sp increases.

When it is determined to be positive in the step S20, the processing moves to a step S21, and the output of the ON driving command to the relay 62 is stopped. For this reason, the plunger 53 is moved by the biasing force of the return spring 55. Accordingly, the contact point 56 is in a blocked state and the driving of the motor 52 starts to be stopped, and then, the pinion gear 51 is disengaged from the ring gear 12.

The coasting control is released by switching the clutch device 20 to be in a power transmission state in the following step S22.

The above-described reduction gear ratio holding processing is released in the following step S23. Accordingly, the process is transitioned to normal transmission control.

In other words, in this embodiment, when the engine 10 is started (for example, initial starting of the engine 10 by a key operation of the driver) except for during the period of time when returning from the coasting control, the transformation portion 64 is not used as an electricity supply source of the starter 50, the switching portion 61 is operated so that the first battery 63 and the contact point 56 are connected to each other, and the cranking is performed by the starter 50.

Figure 5A:
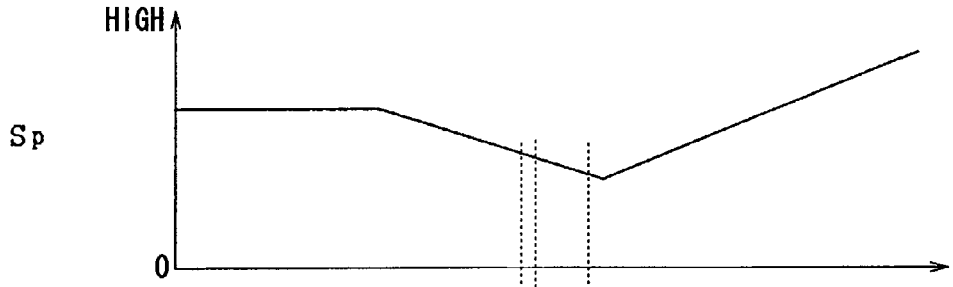
FIGS. 5A to 5D are time charts illustrating processing of returning from the coasting control.
Figure 5B:
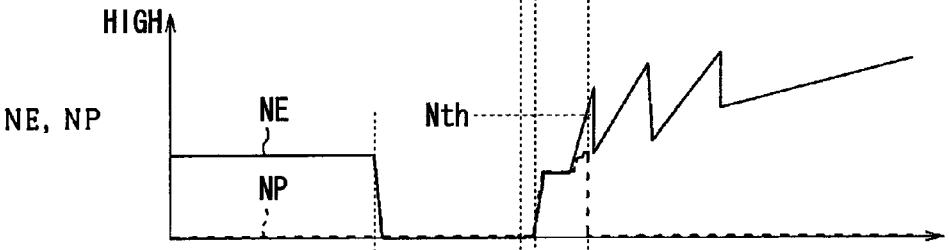
Figure 5C:
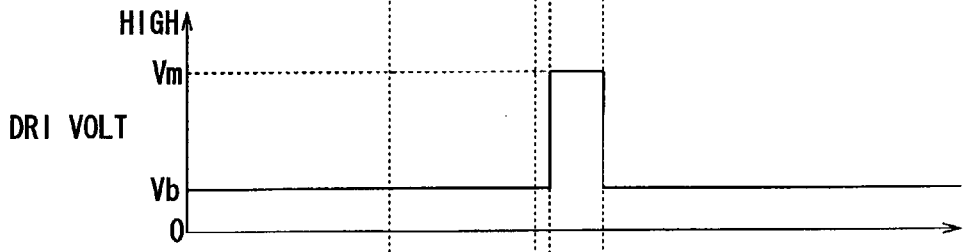
Figure 5D:
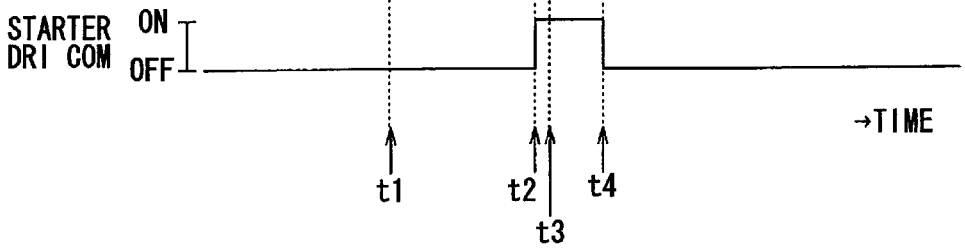

Next, by using FIGS. 5A to 7, effects of this embodiment will be described. In FIGS. 5A to 5D, an example of driving control of the starter 50 when returning from the coasting control is illustrated. FIG. 5A illustrates a change in the vehicle speed Sp, FIG. 5B illustrates a change in the engine rotation speed NE and a rotation speed NP of the pinion gear 51, FIG. 5C illustrates a change in the driving voltage of the starter 50, and FIG. 5D illustrates a change in a driving command of the starter 50 with respect to the relay 62. The rotation speed NP of the pinion gear 51 illustrated in FIG. 5B is a value which is converted to make it possible to be compared with the engine rotation speed NE.

In the illustrated example, the coasting control is started at time t1. After this, by determining that the release condition of the coasting control is established, the ON driving command is output from the control device 60 at time t2. Accordingly, the low voltage Vb is supplied from the first battery 63 to the coil 54. After this, by determining that the pinion gear 51 abuts against the ring gear 12 at time t3, the high voltage Vm which corresponds to the vehicle speed Sp is supplied from the transformation portion 64 to the motor 52. Accordingly, the engine rotation speed NE starts to be raised by driving the motor 52 to be rotated. In FIG. 5C, the high voltage Vm supplied from the transformation portion 64 is illustrated as a constant value for convenience. After this, at time t4 when the engine rotation speed NE reaches the determined speed Nth, the driving of the starter 50 is stopped as the output of the ON driving command is stopped.

Figure 6:
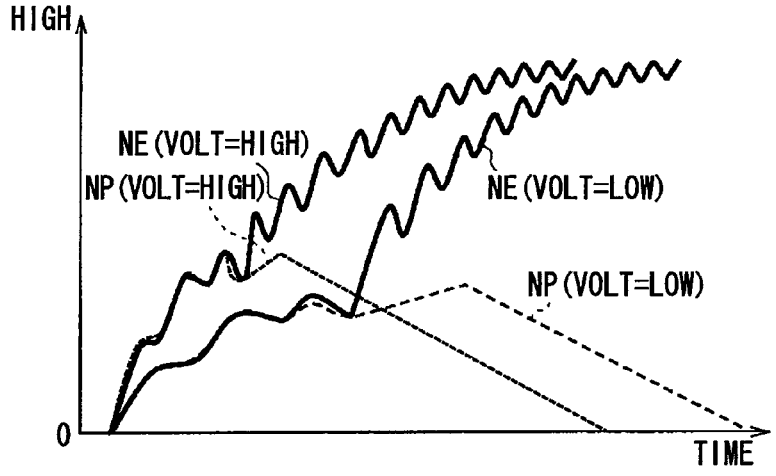
FIG. 6 is a time chart illustrating a relationship between the starter driving voltage, an engine rotation speed, and a pinion rotation speed.
Figure 7:
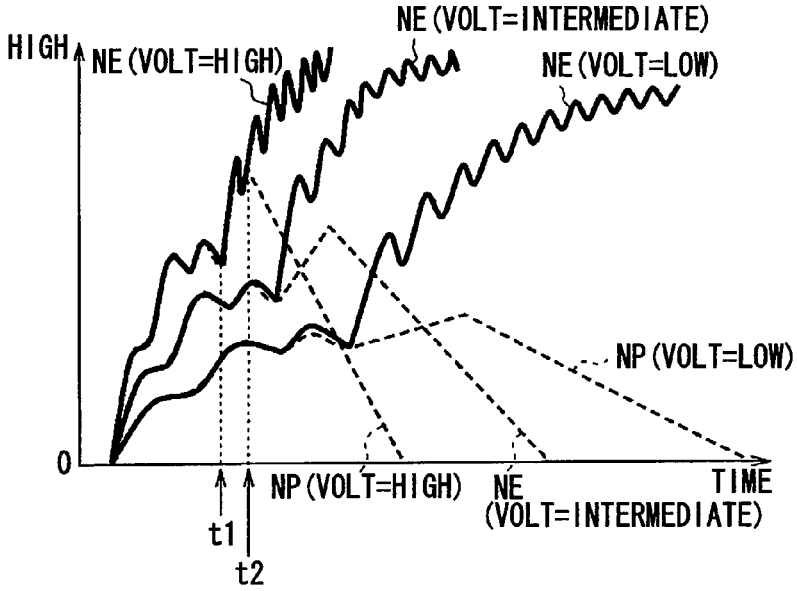
FIG. 7 is a time chart illustrating a relationship between the starter driving voltage, the engine rotation speed, and the pinion rotation speed.

In FIG. 6, a change in the engine rotation speed NE and the rotation speed NP of the pinion gear 51 when the driving voltage of the motor 52 decreases and when the driving voltage of the motor 52 increases, is illustrated. In FIG. 7, a change in the engine rotation speed NE and the rotation speed NP of the pinion gear 51 when the driving voltage of the motor 52 is changed in three stages (for example, 12 V, 24 V, and 48 V), is illustrated.

As illustrated in the drawing, the engine rotation speed NE which can be achieved by cranking can increase, and the raising speed of the engine rotation speed NE can also increase, by increasing the driving voltage of the motor 52. For this reason, the period to the first combustion of the engine 10 can be reduced, and the acceleration of the vehicle can be improved. In addition, since the raising speed of the engine rotation speed NE can increase, a period of time during which a cranking sound is generated can be reduced. Furthermore, since the engine rotation speed NE which can be achieved by cranking can increase, the fuel ejection amount when the engine 10 starts can be reduced.

Since the engine rotation speed NE which can be achieved by cranking can increase, the raising of the engine rotation speed NE also can be assisted by continuing the driving of the starter 50 even after the first combustion of the engine 10 as illustrated at the period from the time t1 to the time t2 of FIG. 7. In this case, the acceleration of the vehicle can be further improved. In other words, a target value of the engine rotation speed NE which is raised by the assist may be set to increase as the vehicle speed Sp increases, for example.

According to this embodiment described above in detail, the following effects can be obtained.

(1) In a case where it is determined that the releasing condition of the coasting control is established, the engine 10 is started by setting the driving voltage supplied to the motor 52 to be higher than that of when the vehicle speed Sp is low and driving the motor 52 to be rotated, when the vehicle speed Sp is high. When the driving voltage of the motor 52 is set to be high, the raising speed of rotation of the ring gear 12 linked to the crank shaft 11 can be set to be high. For this reason, even when returning to the normal traveling state from the coasting control state in which the traveling speed is relatively high, the engine rotation speed can be rapidly raised to the high rotation speed for obtaining desired torque. Accordingly, the acceleration of the vehicle when returning from the coasting control can be improved.

(2) The output voltage Vm supplied to the motor 52 is set to sequentially increase as the vehicle speed Sp increases. For this reason, the amount of time for raising the engine rotation speed to the determined speed Nth can be constant, or drivability during the acceleration of the vehicle can be improved.

(3) After the ON driving command of the starter 50 is given, the output voltage Vb supplied to the coil 54 during the period until the pinion gear 51 abuts against the ring gear 12 is set to be lower than the output voltage Vm supplied to the motor 52 from the transformation portion 64 after the pinion gear 51 abuts against the ring gear 12. For this reason, the period of time from when the driving voltage starts to be supplied to the coil 54 to the time when the motor 52 starts to rotate can increase, and the time until the pinion gear 51 meshes with the ring gear 12 in a state where the pinion gear 51 is not driven to be rotated can be ensured. Accordingly, generation of defective meshing between the pinion gear 51 and the ring gear 12, or an increase in the collision sound between the pinion gear 51 and the ring gear 12 can be restricted.

(4) Only when starting the engine 10 when returning from the coasting control, is the driving voltage supplied to the starter 50 from the transformation portion 64, and when starting the engine 10 except for during the period of time when returning from the coasting control, the driving voltage is supplied to the starter 50 from the first battery 63 in which the output voltage is lower than that of the transformation portion 64 without using the transformation portion 64 as an electricity supply source. As the driving voltage increases, there is a tendency that the lifetime of a component for driving the starter 50, such as the relay 62, is reduced. For this reason, by the configuration in which the driving voltage is supplied to the starter 50 from the transformation portion 64 only when returning from the coasting control, the lifetime of the component for driving the starter 50 can increase.

(5) As the accelerator operation amount Ac1 increases and becomes equal to or greater than the predetermined amount Ath, it is determined that the releasing condition of the coasting control is established. A situation in which the driver starts to step in the accelerator operating member 72 is a situation in which the driver desires to accelerate the vehicle. For this reason, when the engine 10 is rapidly started after the accelerator operating member 72 is started to be stepped in, and the engine rotation speed NE is not rapidly raised to the high rotation speed, deterioration of drivability is caused. In this embodiment, when the vehicle speed Sp is high, the driving voltage supplied to the motor 52 increases compared to that when the vehicle speed Sp is low. Accordingly, the engine rotation speed can be rapidly raised to the high rotation speed which corresponds to the vehicle speed, and deterioration of drivability can be prevented.

(6) During the period of time from when the coasting control is initiated to the time when the coasting control is released, the automatic transmission 30 is operated to hold the gear ratio immediately before transitioning to the current coasting control. Since the traveling speed immediately before transitioning to the coasting control is relatively high, the gear ratio is a relatively low value. For this reason, by holding the gear ratio, a difference in the rotation speed between the input shaft 31 of the automatic transmission 30 and the crank shaft 11 can be reduced in a case where the clutch device 20 is switched from a power blocking state to a power transmission state. Accordingly, a shock due to the switching of the clutch device 20 to a power transmission state can be reduced, and deterioration of the engine rotation speed due to the switching of the clutch device 20 to a power transmission state can be restricted. Therefore, the acceleration of the vehicle when returning from the coasting control can be improved.

Second Embodiment

Figure 8:
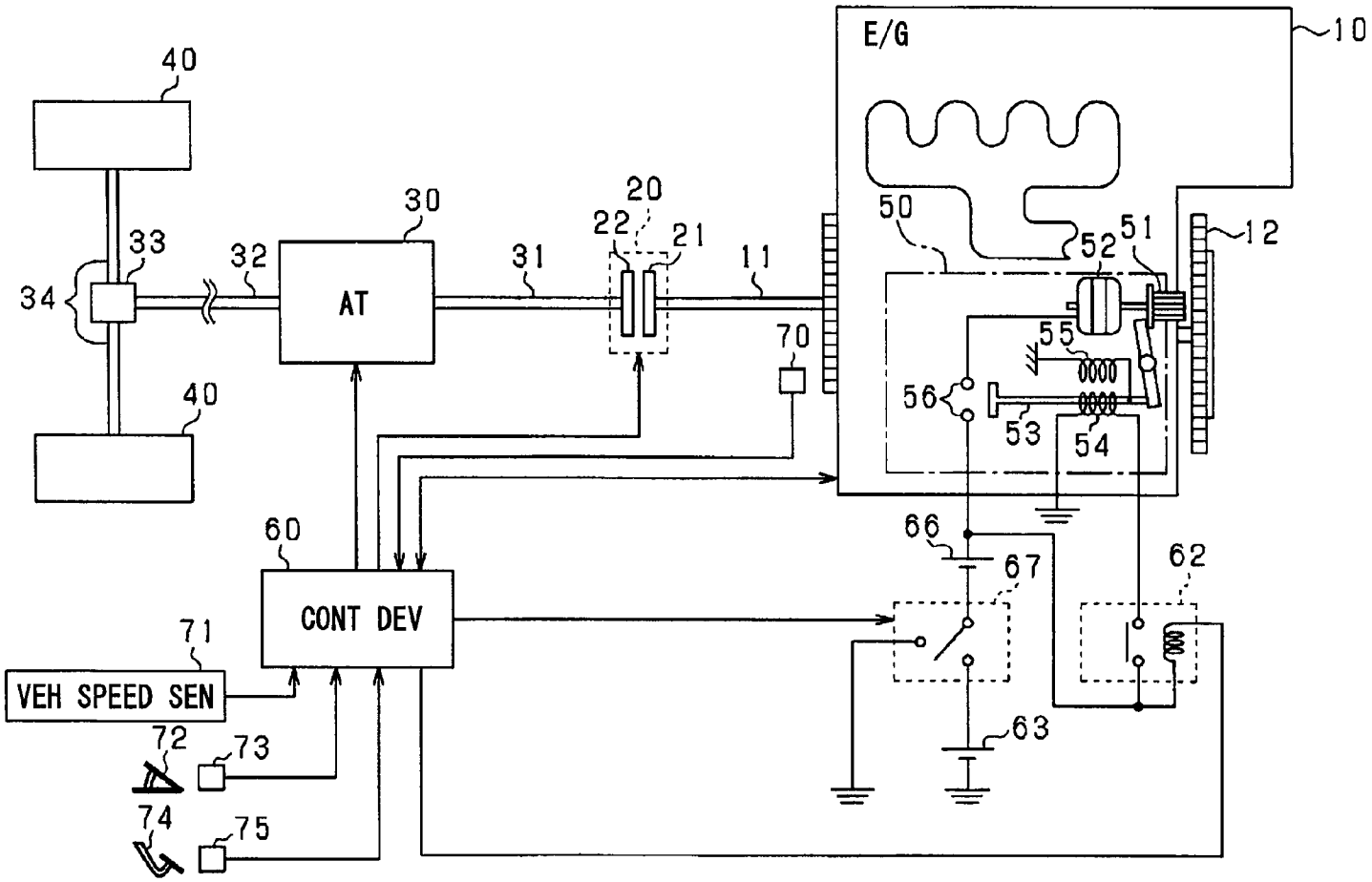
FIG. 8 is a configuration view of the entire onboard system according to a second embodiment.

Hereinafter, a second embodiment will be described with reference to the drawings focusing on differences from the above-described first embodiment. As illustrated in FIG. 8, in this embodiment, changing device of the driving voltage supplied to the starter 50 is changed. Specifically, a negative electrode terminal of a second battery 66 is connected to a positive electrode terminal of the first battery 63 via a switching portion 67. Each of the contact point 56 and the relay 62 is connected to the positive electrode terminal of the second battery 66. The negative electrode terminal of the first battery 63 is grounded. The switching portion 67 operates the negative electrode terminal of the second battery 66 to be conducted by the control device 60 in order to be connected to any one of the positive electrode terminal and a grounded part of the first battery 63.

Next, the processing of returning from the coasting control according to this embodiment will be described. A main point of distinction from the processing illustrated in FIG. 2 above will be described. In this embodiment, the switching portion 67 is operated to be conducted so that the negative electrode terminal of the second battery 66 is connected to the grounded part in the steps S15 and S16 of FIG. 2 above. Accordingly, the output voltage of the second battery 66 is supplied to the coil 54. In addition, the processing of the step S17 is removed. Furthermore, the switching portion 67 is operated to be conducted so that the negative electrode terminal of the second battery 66 is connected to the positive electrode terminal of the first battery 63 in the step S19. Accordingly, the output voltage of a serially connected body of the first battery 63 and the second battery 66 is supplied to the motor 52.

In this manner, in this embodiment, the driving voltage of the motor 52 when it is determined that the vehicle speed Sp is equal to or greater than the regulation speed Sth in the step S14 of FIG. 2 above can be set to be higher than the driving voltage of the motor 52 when it is determined that the vehicle speed Sp is less than the regulation speed Sth. Accordingly, the driving voltage of the motor 52 can be switched in two stages in accordance with the vehicle speed Sp. Therefore, the effects which are equivalent to the effects of the above-described first embodiment can be obtained.

Another Embodiment

Each of the above-described embodiments may be changed and realized as follows.

In the step S13 of FIG. 2 above, as it is determined that the brake operation amount increases and becomes equal to or greater than a predetermined value based on a detected value of the brake sensor 75, it may be determined that the releasing condition of the coasting control is established.

Figure 9:
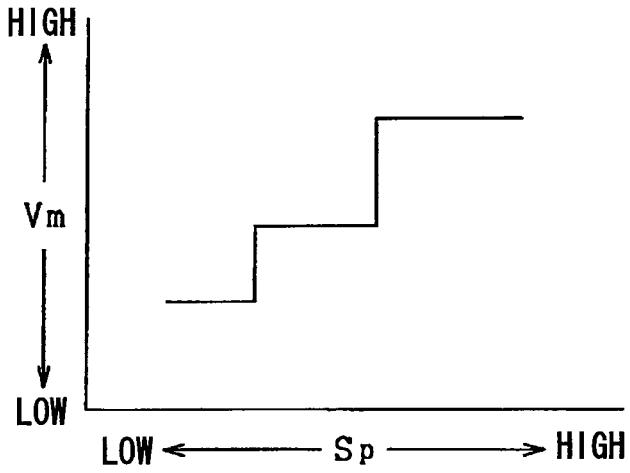
FIG. 9 is a view illustrating a relationship between the traveling speed and the starter driving voltage according to another embodiment.

As illustrated in FIG. 9, the output voltage Vm supplied to the motor 52 may be gradually increased as the vehicle speed Sp increases in the step S17 of FIG. 2 above. In this case, the effects which are equivalent to the effects of (2) of the above-described first embodiment can be obtained. In FIG. 9, an example in which the output voltage Vm is set in three stages is illustrated, but the disclosure is not limited thereto.

In each of the above-described embodiments, the voltage supplied to the coil 54 during the period when the pinion gear 51 moves from the non-linking position to the linking position may be a voltage which is lower than the output voltage of the first battery 63. In this case, the period until the pinion gear 51 meshes with the ring gear 12 can further be ensured.

As a starter, a tandem type starter which can perform the rotation driving of the pinion gear by a motor and control separately from extrusion of the pinion gear may be employed. A starter is not limited to a pinion extrusion type, and may be a constant meshing type in which the pinion gear constantly meshes with the ring gear. In both cases of the tandem type and a constant meshing type, when returning from the coasting control, the engine rotation speed is required to be rapidly raised to the high rotation speed. For this reason, a configuration in which, when the vehicle speed Sp is high, the output voltage Vm supplied to the motor is set to be higher than that of when the vehicle speed Sp is low when returning from the coasting control, is effective.

It is noted that a flowchart or the processing of the flowchart in the present application includes sections (also referred to as steps), each of which is represented, for instance, as S11. Further, each section can be divided into several sub-sections while several sections can be combined into a single section. Furthermore, each of thus configured sections can be also referred to as a device, module, or means.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. An internal combustion engine starting device for a vehicle that includes: an internal combustion engine as a traveling power source; a clutch device arranged on a power transmission path for linking an output shaft of the internal combustion engine and a driving wheel; a starter having a motor for applying an initial rotation to a ring gear linked to the output shaft; and a voltage changing device for changing a driving voltage supplied to the starter, the internal combustion engine starting device comprising:

a starting requirement determination device that determines whether the internal combustion engine is required to be started in a state where the internal combustion engine stops combustion by stopping fuel supply to the internal combustion engine, and the vehicle is in a freewheel running with setting a clutch device to be in a power blocking state; and a driving control device that drives and rotates the motor by increasing a driving voltage supplied to the motor from the voltage changing device in a case where a travelling speed is high to be higher than in a case where the traveling speed is low, when the starting requirement determination device that determines that the internal combustion engine is required to be started.

2. The internal combustion engine starting device according to claim 1, wherein:

the driving control device sequentially increases the driving voltage supplied to the motor as the traveling speed increases.

3. The internal combustion engine starting device according to claim 1, wherein:

the driving control device step-wisely increases the driving voltage supplied to the motor as the traveling speed increases.

4. The internal combustion engine starting device according to claim 1, wherein:

the starter includes:

a pinion gear that is movable between a linking position where the pinion gear engages with the ring gear and a non-linking position where the pinion gear does not engage with the ring gear, and transmits a rotating force of the motor; and a pinion shift device that has a function for extruding the pinion gear from the non-linking position to the linking position by supplying electricity from the voltage changing device, and a function for extracting the pinion gear from the linking position to the non-linking position;

the voltage changing device starts to supply the driving voltage to the motor after the voltage changing device supplies the driving voltage to the pinion shift device, and the pinion gear starts to move toward the linking position from the non-linking position; and a time interval until the motor starts to rotate after the driving voltage is supplied to the pinion shift device is reduced as the driving voltage supplied to the pinion shift device from the voltage changing device increases.

5. The internal combustion engine starting device according to claim 4, wherein:

the driving control device decreases the driving voltage supplied to the pinion shift device from the voltage changing device in a period when the pinion gear moves from the non-linking position to the linking position to be lower than the driving voltage supplied to the motor from the voltage changing device after the pinion gear moves to the linking position.

6. The internal combustion engine starting device according to claim 4, wherein:

the pinion shift device includes:

a plunger that is mechanically connected to the pinion gear;

a spring that applies a biasing force to the plunger in a direction, in which the pinion gear is oriented from the linking position to the non-linking position; and a coil that suctions and moves the plunger in a direction, in which the pinion gear is oriented from the non-linking position to the linking position, when the coil is energized;

the starter includes a contact point for electrically connecting between the voltage changing device and the motor; and when the pinion gear moves to the linking position, the plunger provides a conduction state at the contact point.

7. The internal combustion engine starting device according to claim 1, wherein:

the starting requirement determination device determines that the internal combustion engine is required to be started when an operation amount of an accelerator operating member operated by a driver increases to be equal to or more than a predetermined amount.

8. The internal combustion engine starting device according to claim 1, wherein:

the vehicle further includes an automatic transmission is arranged on the power transmission path to be closer to the driving wheel than the clutch device;

the automatic transmission has an input shaft, which is mechanically connected to a clutch device side;

the automatic transmission has an output shaft, which is mechanically connected to a driving wheel side; and a value calculated by dividing a rotation speed of the input shaft by a rotation speed of the output shaft is defined as a gear ratio, the internal combustion engine starting device further comprising:

a transformation operation device that operates the automatic transmission to reduce the gear ratio in a case where the travelling speed is high to be smaller than in a case where the traveling speed is low; and a holding operation device that operates the automatic transmission to hold the gear ratio immediately before transitioning to the freewheel running in a period until the internal combustion engine starts the combustion according to a starting requirement, and the clutch device is switched to a power transmission state after the vehicle starts the freewheel running.

* * * * *